US012729559B2

(12) United States Patent
Shao

(10) Patent No.: US 12,729,559 B2
(45) Date of Patent: Sep. 8, 2026

(54) OUTDOOR AWNING

(71) Applicant: Ningbo Easun Technology Co., Ltd, Ningbo (CN)

(72) Inventor: Min Shao, Ningbo (CN)

(73) Assignee: Ningbo Easun Technology Co., Ltd, Ningbo (CN)

( * ) Notice: Subject to any disclaimer, the term of this patent is extended or adjusted under 35 U.S.C. 154(b) by 252 days.

(21) Appl. No.: 18/236,946

(22) Filed: Aug. 23, 2023

(65) Prior Publication Data

US 2025/0034903 A1 Jan. 30, 2025

(30) Foreign Application Priority Data

Jul. 27, 2023 (CN) ..... 202321994985.5

(51) Int. Cl.
*E04H 15/58* (2006.01)

(52) U.S. Cl.
CPC ..... *E04H 15/58* (2013.01)

(58) Field of Classification Search
CPC ..... E04H 15/58; E04H 15/34; E04B 7/163; E04F 10/005; E04F 10/08; E04F 10/008
See application file for complete search history.

(56) References Cited

U.S. PATENT DOCUMENTS 2,524,961 A * 10/1950 Cramer, Jr. ..... F16M 7/00 254/104
3,390,862 A * 7/1968 Schrepfer ..... F16M 7/00 254/104
3,714,738 A * 2/1973 Koslow ..... E05D 13/06 49/404
3,791,076 A * 2/1974 Gahler ..... F16B 5/0692 52/63
4,104,830 A * 8/1978 Eagle ..... E06B 1/70 49/468
4,156,325 A * 5/1979 McMullen ..... E06B 1/70 49/468
4,411,045 A * 10/1983 Rock ..... E05D 5/0276 16/248
4,805,358 A * 2/1989 Fork ..... E04B 5/48 52/126.2
5,729,103 A * 3/1998 Domel ..... E06B 9/32 318/16
5,873,202 A * 2/1999 Parks ..... E04B 7/163 49/77.1

(Continued)

*Primary Examiner* — Daniel P Cahn
*Assistant Examiner* — Matthew R. Shepherd

(57) ABSTRACT

Provided is an outdoor awning, including a ceiling, a driving mechanism, support legs, and tensioning mechanisms, where the ceiling includes a frame structure and a plurality of louvers disposed on the frame structure, the louvers are rotatably installed on the frame structure, and connecting rods are disposed at end portions of the louvers to achieve linkage; the driving mechanism is installed on the ceiling, and is connected to one of the louvers to drive same to rotate; at least three support legs are available and fixed on side walls of the ceiling for supporting the ceiling; and the tensioning mechanisms are fixed on the side walls of the ceiling, and the support legs are provided with insertion holes, into which the tensioning mechanisms can be inserted to achieve tensioning and fixation. The outdoor awning is compact in structure, convenient to assemble and good in user experience.

9 Claims, 22 Drawing Sheets

(56) References Cited

U.S. PATENT DOCUMENTS

| | | | | |
|---|---|---|---|---|
| 7,357,364 | B2 * | 4/2008 | Jackson | F16B 2/04 411/75 |
| 8,925,258 | B1 * | 1/2015 | Header | E05D 15/00 52/767 |
| 9,422,715 | B1 * | 8/2016 | Selzer | E04D 11/00 |
| 9,861,191 | B1 * | 1/2018 | Song | A63D 15/00 |
| 9,895,792 | B2 * | 2/2018 | Chen | B25B 5/10 |
| 10,094,122 | B1 * | 10/2018 | Akbulut | E04B 7/163 |
| 10,753,139 | B2 * | 8/2020 | Wang | E06B 1/342 |
| 10,851,544 | B1 * | 12/2020 | Volin | E04F 10/10 |
| 2006/0040607 | A1 * | 2/2006 | Perez | E04B 7/163 454/358 |
| 2007/0193615 | A1 * | 8/2007 | Stevenson | B65B 43/305 135/157 |
| 2010/0269291 | A1 * | 10/2010 | Haab | E05D 15/58 16/91 |
| 2013/0111702 | A1 * | 5/2013 | Ewing | E05D 15/0634 29/428 |
| 2013/0219797 | A1 * | 8/2013 | Bonomie | E05D 7/0423 16/382 |
| 2013/0291438 | A1 * | 11/2013 | Selzer | E04B 7/163 49/82.1 |
| 2015/0252586 | A1 * | 9/2015 | Schaefer | E04H 15/34 135/121 |
| 2017/0335595 | A1 * | 11/2017 | Pan | E04H 15/58 |
| 2019/0338528 | A1 * | 11/2019 | Torman | E04F 10/10 |
| 2020/0181918 | A1 * | 6/2020 | Auer | E04B 1/34321 |
| 2021/0332587 | A1 * | 10/2021 | Geriavenko | E04F 10/10 |
| 2021/0363752 | A1 * | 11/2021 | Wagaman | E04F 10/10 |
| 2022/0235555 | A1 * | 7/2022 | Liang | H02S 20/10 |
| 2022/0372764 | A1 * | 11/2022 | Wang | E04F 10/10 |
| 2024/0200337 | A1 * | 6/2024 | Shen | E06B 9/28 |

* cited by examiner

OUTDOOR AWNING

CROSS REFERENCE TO RELATED APPLICATIONS

The present application claims the benefit of Chinese Patent Application No. 2023219949855 filed on Jul. 27, 2023, the contents of which are incorporated herein by reference in their entirety.

TECHNICAL FIELD

The present disclosure relates to an outdoor article, and in particular to an outdoor awning.

BACKGROUND ART

An awning is generally composed of cross beams (top beams) and stand columns (shed legs). The structural form of the awning may be a trapezoidal shed (a shed bracket), a reinforced shed, a polygonal shed, a retractable curved shed, a hinged curved shed, or a horseshoe-shaped shed. The existing awnings are usually directly subjected to sunshade treatment through alloy materials for ceilings, which cannot adjust the amount of shielding, have a relatively single function, and are inconvenient to assemble.

SUMMARY OF THE INVENTION

[1] Technical Problem to be Solved

The technical problem to be solved by the present disclosure is to provide an outdoor awning, which is compact in structure, convenient and labor-saving to assemble, adjustable in shading amount, and good in user experience.

[2] Technical Solution for Solving Problem

The present disclosure provides an outdoor awning, which includes:

- a ceiling, as a sunshade main body, including a frame structure and a plurality of louvers 3 disposed on the frame structure, where the louvers 3 are rotatably installed on the frame structure, rotation axes of the louvers 3 are parallel to length directions thereof, and connecting rods 7 are disposed at end portions of the louvers 3 to achieve linkage;
- a driving mechanism, installed on the ceiling and connected to one of the louvers 3 to drive same to rotate;
- support legs 4, fixed on side walls of the ceiling for supporting the ceiling 3; and
- tensioning mechanisms, fixed on the side walls of the ceiling, where the support legs 4 are provided with insertion holes 40, into which the tensioning mechanisms can be inserted to achieve tensioning and fixation.

Further, each of the tensioning mechanisms includes a first tensioning block 51, a second tensioning block 52, a locking bolt 53 and a locking nut 54, the first tensioning block 51 is fixed on the side wall of the ceiling, the locking bolt 53 passes through the first tensioning block 51 and the second tensioning block 52 sequentially from top to bottom and is connected to the locking nut 54, the locking nut 54 is in sliding fit with the corresponding support leg 4, and a contact surface between the first tensioning block 51 and the second tensioning block 52 is an inclined surface.

Further, side walls of the first tensioning blocks 51 and/or the second tensioning blocks 52 are provided with serrated edges 5*a*.

Further, each of the support legs 4 is provided with the at least two tensioning mechanisms, which are located on different planes.

Further, a boss 511 is disposed on a rear end face of each of the first tensioning blocks 51, mounting surfaces for fitting side walls of the support legs 4 are formed on end faces of the bosses 511, and an interstice is reserved between each of the mounting surfaces and the side wall of the corresponding first tensioning block 51 for formation of an insertion slot.

Further, the frame structure includes two first cross beams 1 disposed in parallel, and second cross beams 2 are fixed to two ends of the first cross beams 1 so as to form the rectangular frame structure: each of the first cross beams is provided with a strip-shaped protrusion 11 along a length direction for formation of a mounting portion, the mounting portion is provided with mounting grooves 110, the mounting grooves 110 are formed equidistantly along a length direction of the mounting portion, and mounting bases 61 are disposed inside the mounting grooves 110; and hinge shafts 39 are disposed at the end portions of the louvers 3, and the hinge shafts are sleeved inside shaft holes of the mounting bases to achieve rotary connection.

Further, the strip-shaped protrusions 11 are provided with strip-shaped clamping strips 62 for limiting the hinge shafts.

Further, the louvers, the frame structure and the support legs are all made of aluminum profiles.

Further, each of the plurality of louvers includes a louver body with a rectangular cross section; a bottom surface of the louver body extends forward for formation of a first shielding portion 321, an end portion of the first shielding portion 321 is bent upward for formation of a second shielding portion 322, and an end portion of the second shielding portion 322 is bent backward for formation of a third shielding portion 323: a first shielding area is defined by the first shielding portion, the second shielding portion and the third shielding portion: a top surface of the louver body extends backward for formation of a fourth shielding portion 311, and an end portion of the fourth shielding portion 311 is bent downward for formation of a fifth shielding portion 312; and when in a shielding station, the fifth shielding portion 312 is located in the first shielding area of the adjacent louvers and is configured to shield an interstice between the two adjacent louvers.

Further, each of the support legs 4 includes a support leg body with a rectangular cross section, inner walls of the support leg body are provided with parallel strip-shaped clamping strips 401, the length directions of the strip-shaped clamping strips are parallel to the length direction of the support leg body, end portions of the strip-shaped clamping strips are bent in opposite directions for formation of a limiting portion 402, the insertion holes 40 are formed between the limiting portion and the strip-shaped clamping strips, and the at least two insertion holes 40 are available and reserved in the two adjacent inner walls of the support leg body.

Further, the driving mechanism includes a gear box 10 and a worm gear box 9, the gear box 10 is internally provided with a first gear 101 and a second gear 102 which are engaged with each other, and the number of teeth of the second gear 102 is greater than that of the first gear 101: a driven gear 103 is fixed at an end portion of a hinge shaft of one of the louvers, and the driven gear 103 is engaged with the second gear 102; and when a power end is manually operated, an output shaft of the worm gear box is connected to the first gear, and when the power end is driven by electricity, the output shaft of the worm gear box is connected to the second gear.

Further, the driving mechanism includes a first shifting lever 72 and a second shifting lever 73, the first shifting lever 72 is hinged at an end portion of one of the louvers and its rotation axis is parallel to the rotation axis of the louver, the second shifting lever is hinged at an end portion of the first shifting lever, and an end portion of the second shifting lever is rigidly connected to an output end of the worm gear box for driving the first shifting lever to shift the louver to rotate.

Further, a connecting assembly 11 fixedly connected to a wall surface is disposed at one side of the frame structure, the connecting assembly 11 includes a fixing plate 1102 fixedly connected to the wall surface by means of expansion bolts 1103 and a connecting seat 1101 fixedly connected to the fixing plate 1102 by means of connecting bolts 1104, and the connecting seat 1101 is fixed on the frame structure by means of bolts or rivets 1105.

[3] Beneficial Effects

According to the outdoor awning provided by the present disclosure, the ceiling adopts a louver structure, which can adjust the amount of shielding according to needs, so that the outdoor awning is comfort to use and good in user experience. The shielding portions are provided on the louvers and a frame for shielding the interstices between the two adjacent louvers as well as between the louvers and the frame, which avoids rainwater and the like dripping into the awning, so that the awning is good in shielding effect and user experience. The support legs adopt the tensioning mechanisms, and are fixed by tensioning, so that the awning is convenient and labor-saving to assemble, and high in connection strength. The entire awning is made of the aluminum profiles, with high structural strength and light weight, making it easy to carry. Therefore, the outdoor awning provided by the present disclosure is compact in structure, convenient to assemble and good in user experience.

DETAILED DESCRIPTION OF THE INVENTION

Figure 1:
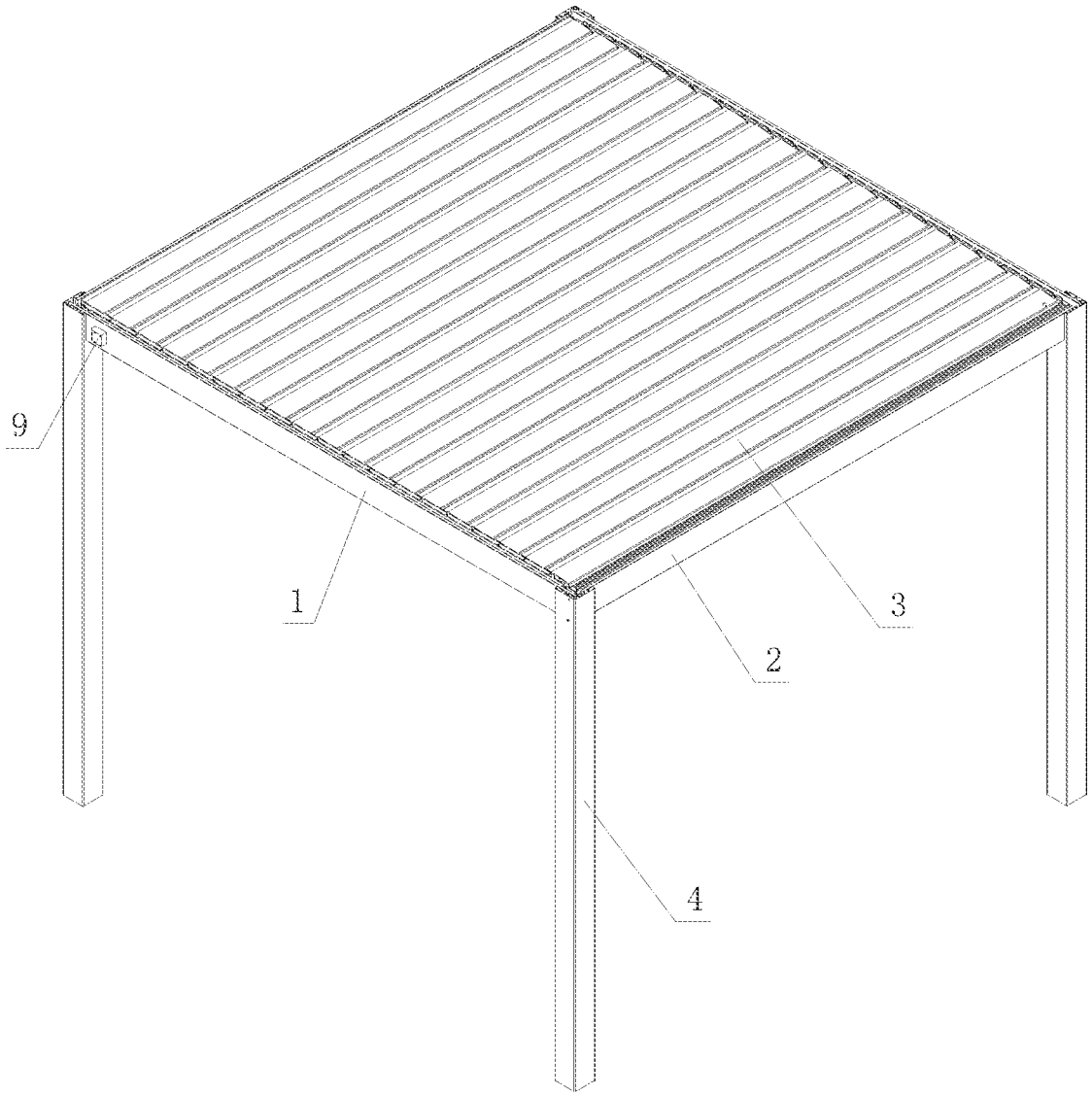
FIG. 1 is a schematic structural diagram of an outdoor awning according to the present disclosure.
Figure 2:
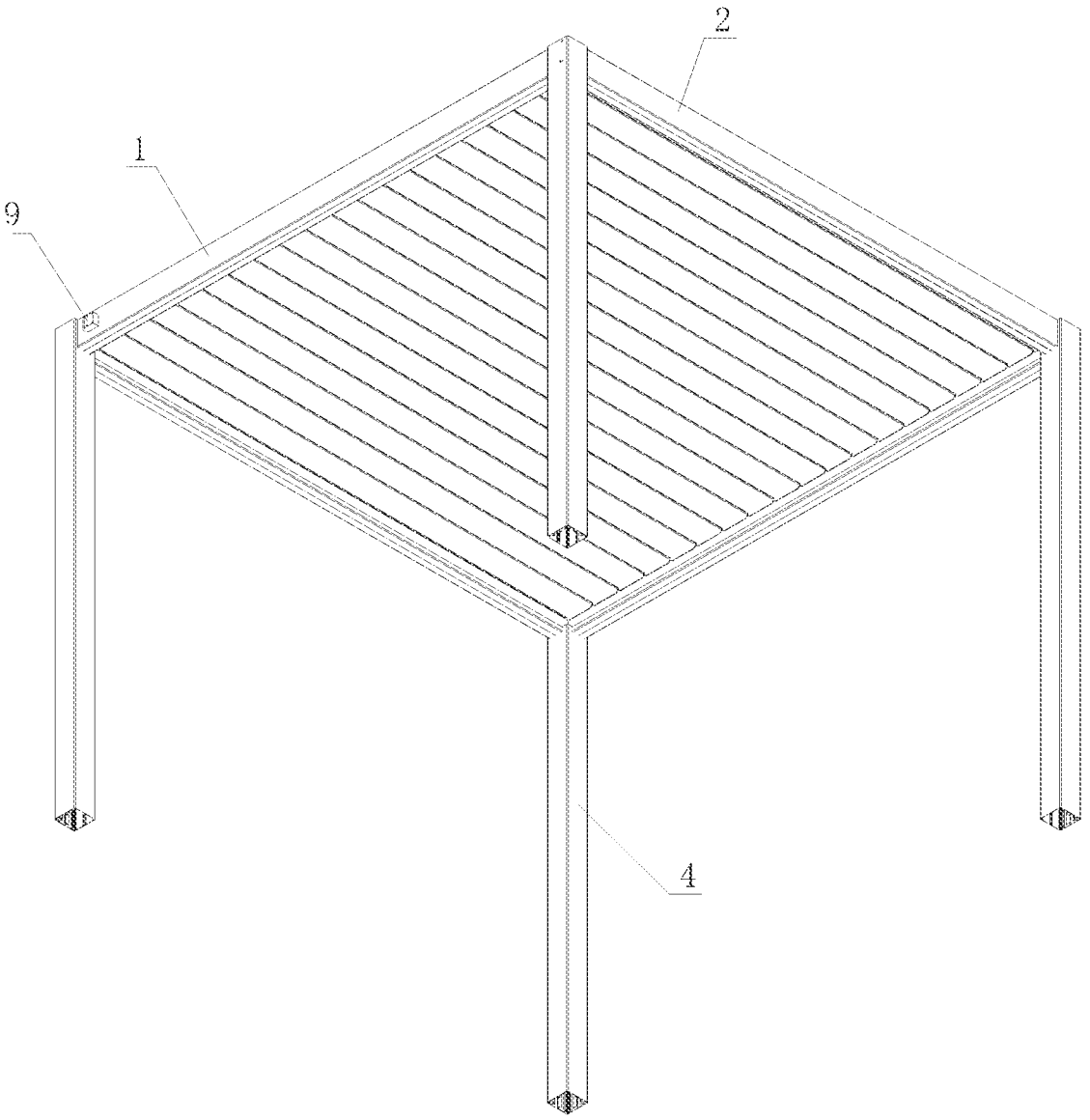
FIG. 2 is a schematic structural diagram of the outdoor awning from another angle according to the present disclosure.
Figure 3:
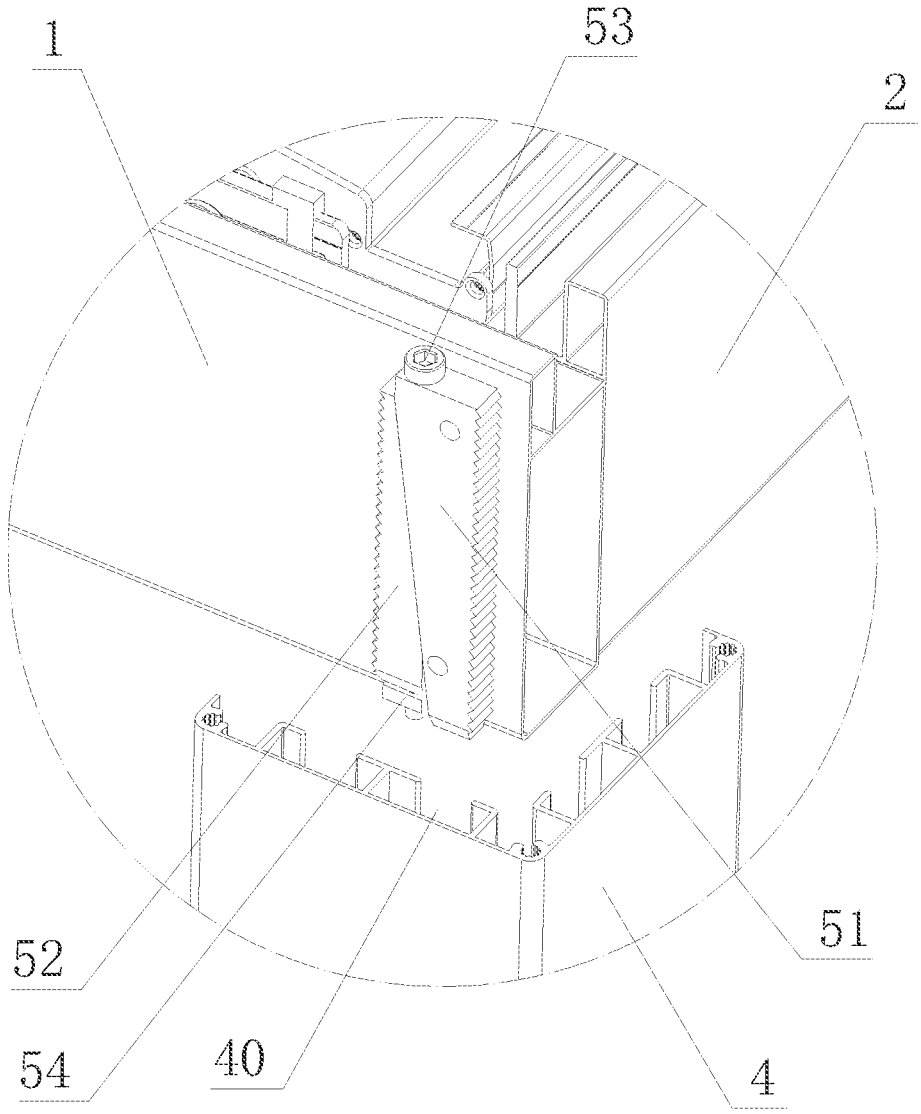
FIG. 3 is a schematic diagram showing the installation of a tensioning mechanism of the outdoor awning according to the present disclosure.
Figure 4:
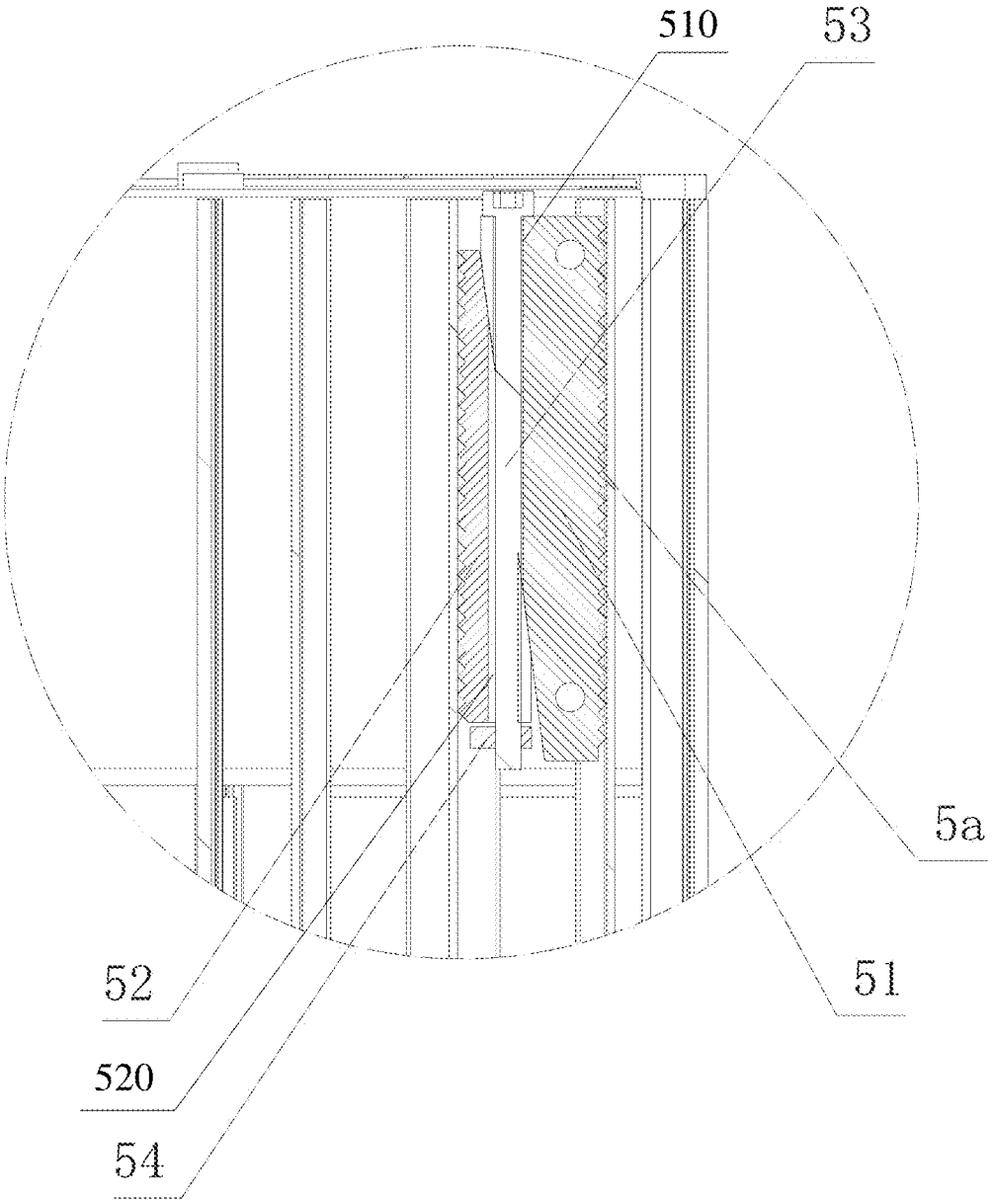
FIG. 4 is a cross-sectional view of the tensioning mechanism of the outdoor awning according to the present disclosure.
Figure 5:
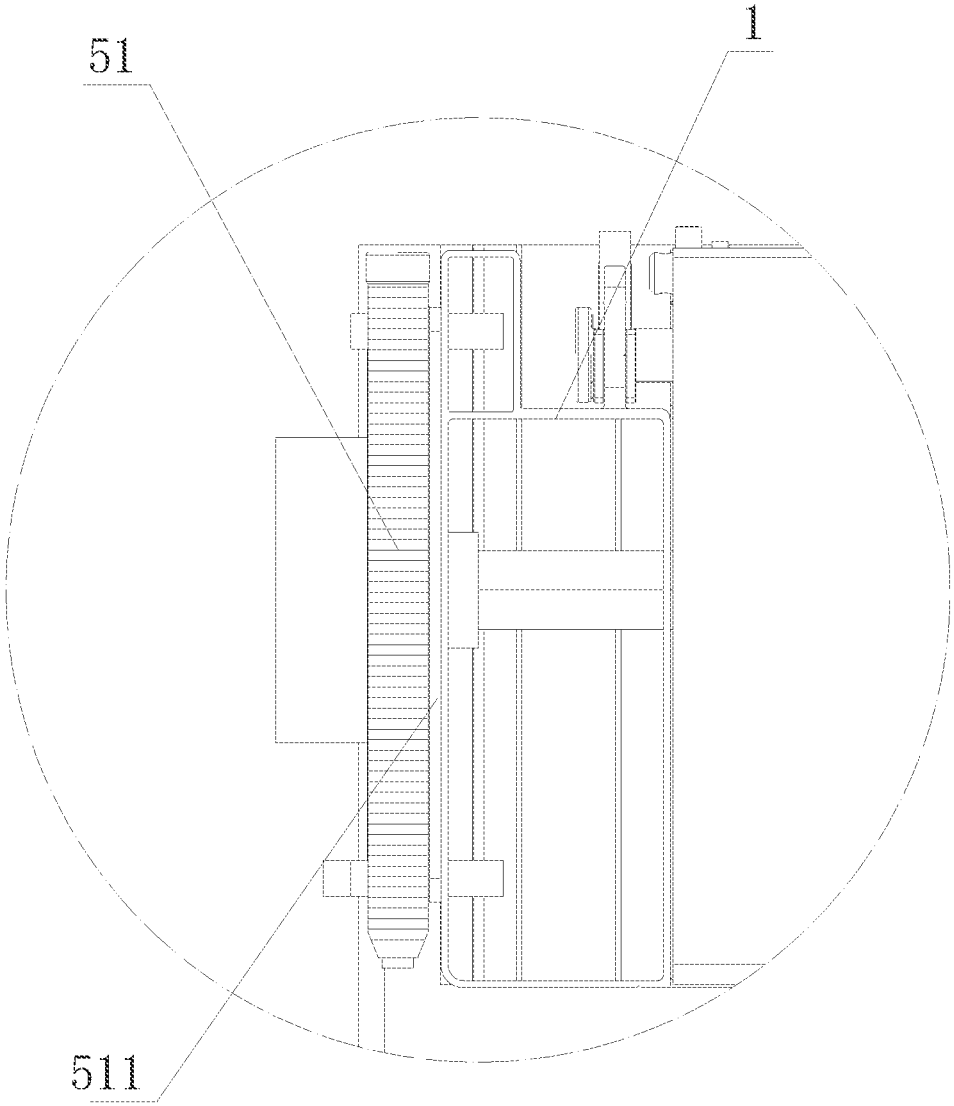
FIG. 5 is a side view of the tensioning mechanism of the outdoor awning according to the present disclosure.
Figure 6:
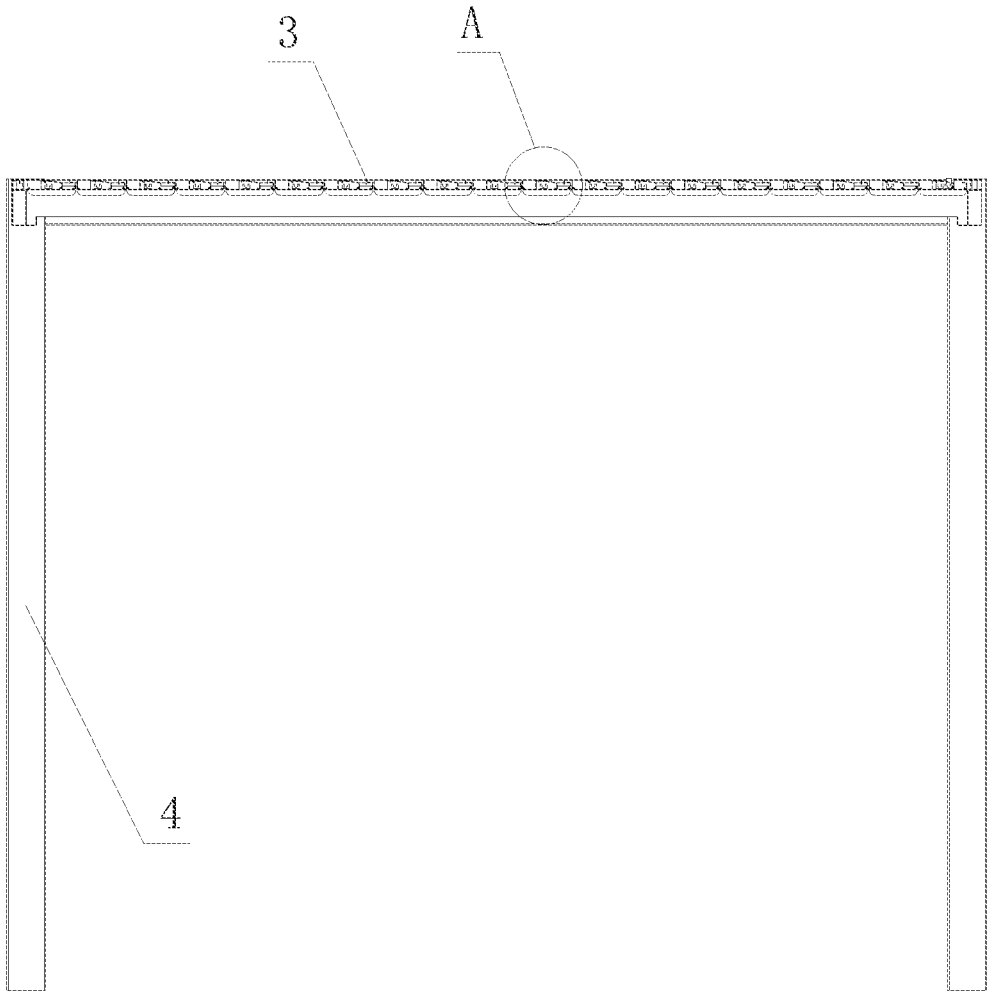
FIG. 6 is a schematic diagram showing the installation of louvers of the outdoor awning according to the present disclosure.
Figure 7:
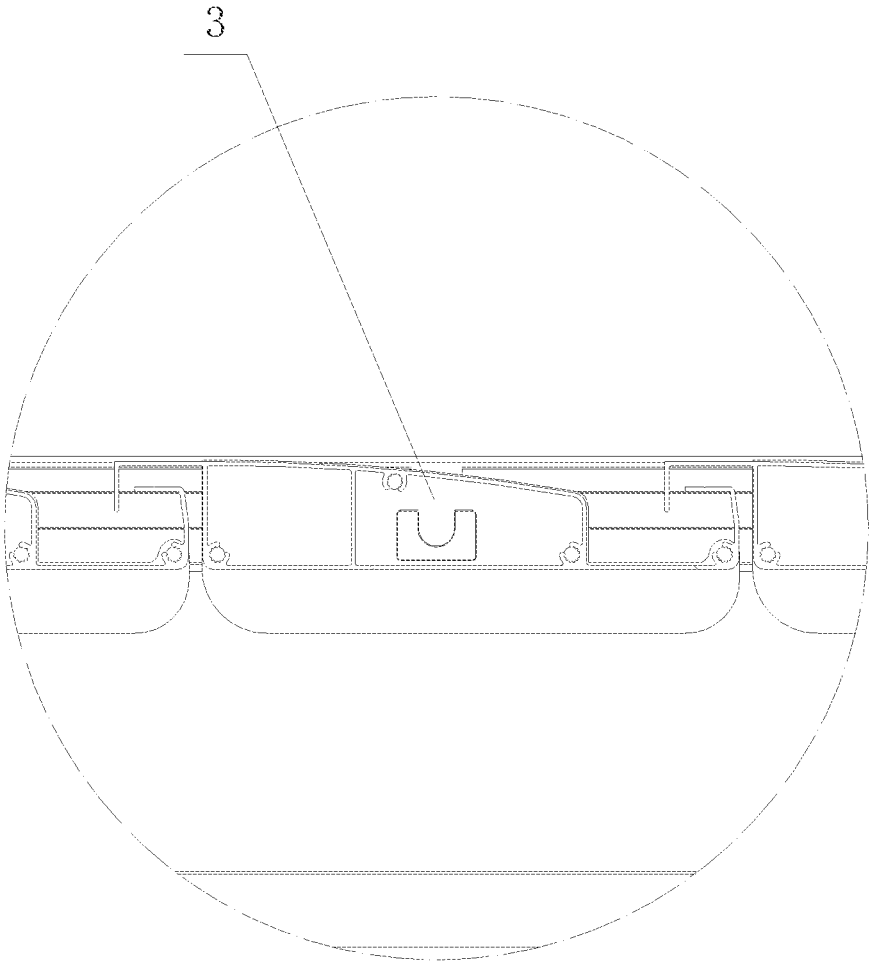
FIG. 7 is an enlarged view of Part A in FIG. 6.
Figure 8:
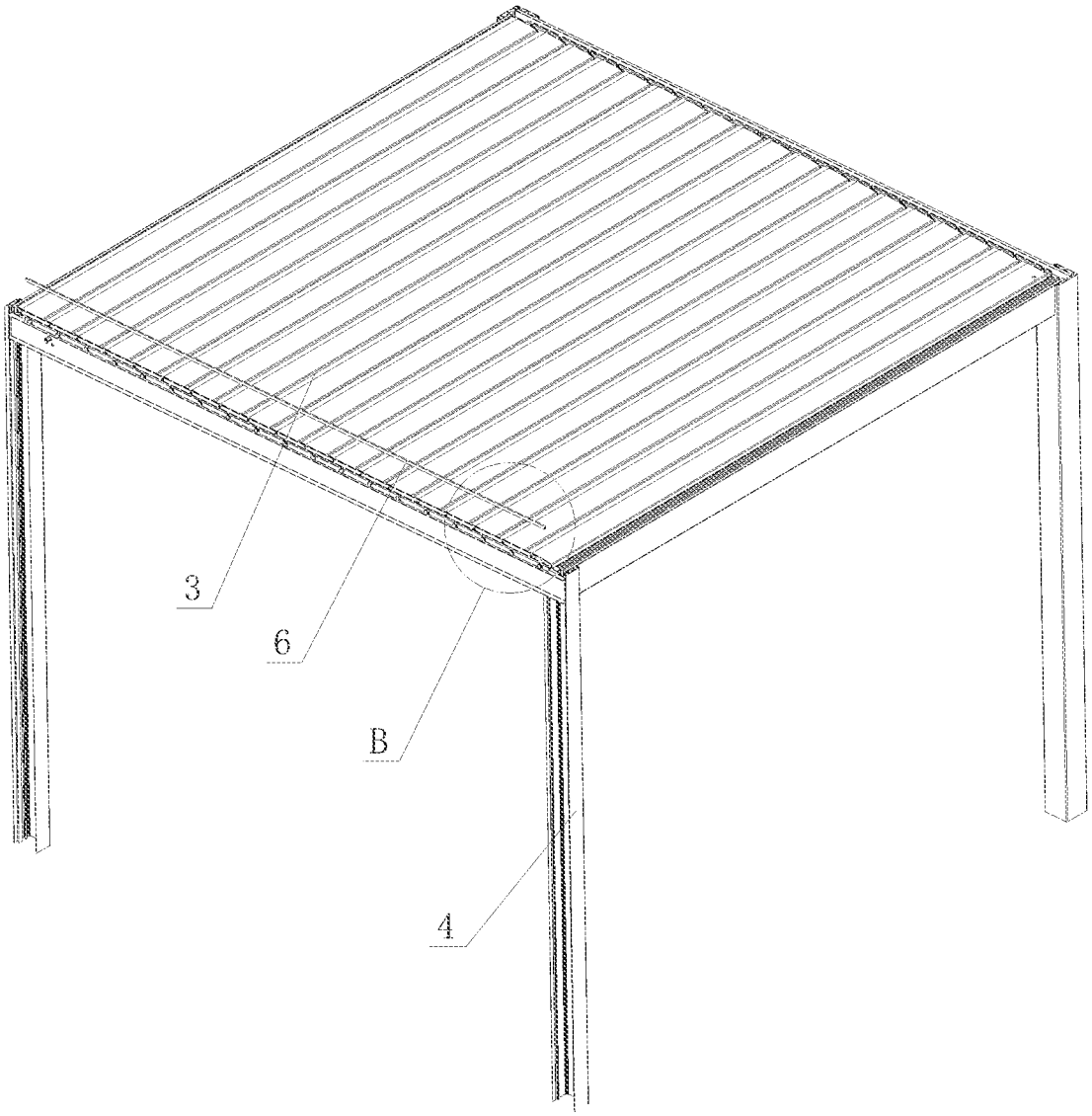
FIG. 8 is a schematic diagram showing the installation of strip-shaped clamping strips of the outdoor awning according to the present disclosure.
Figure 9:
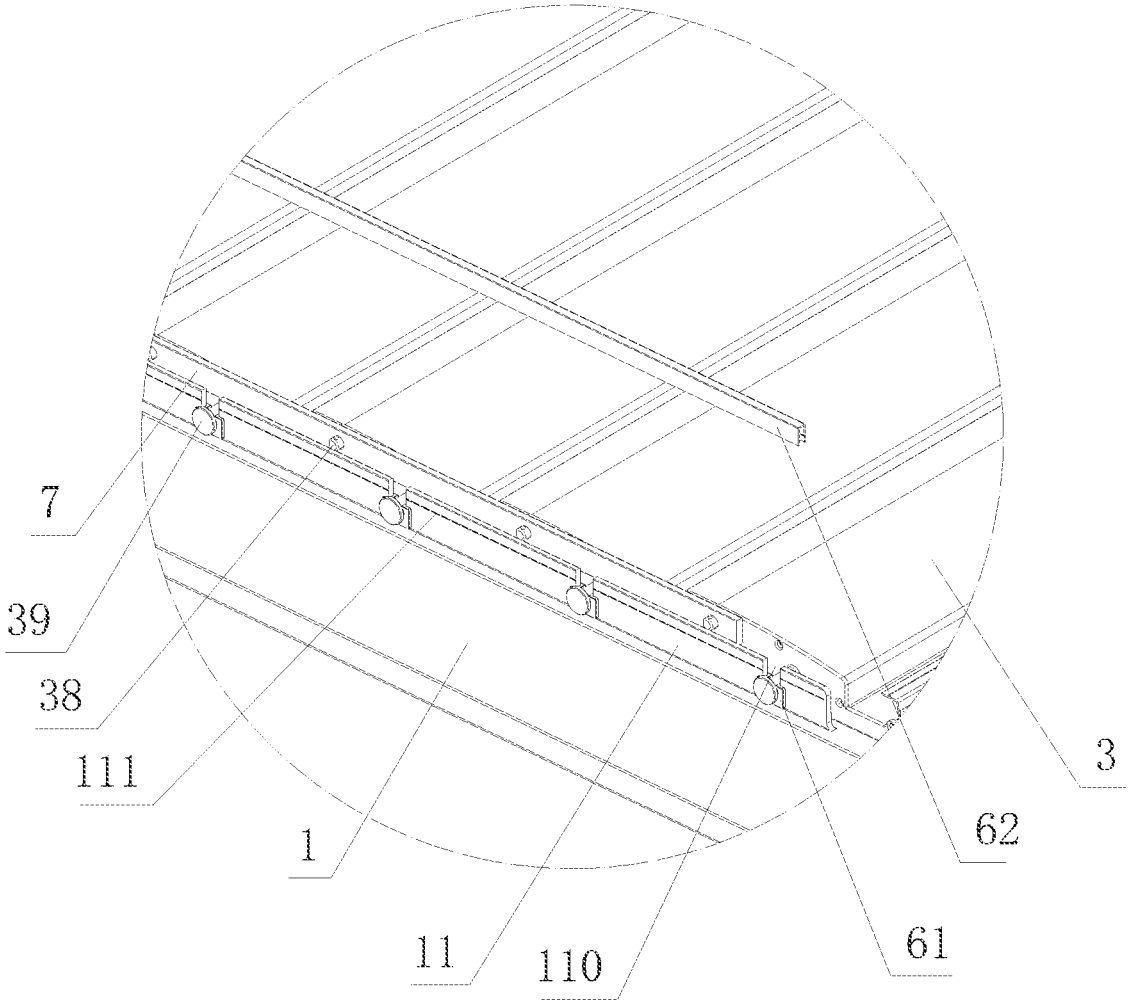
FIG. 9 is an enlarged view of Part B in FIG. 8.
Figure 10:
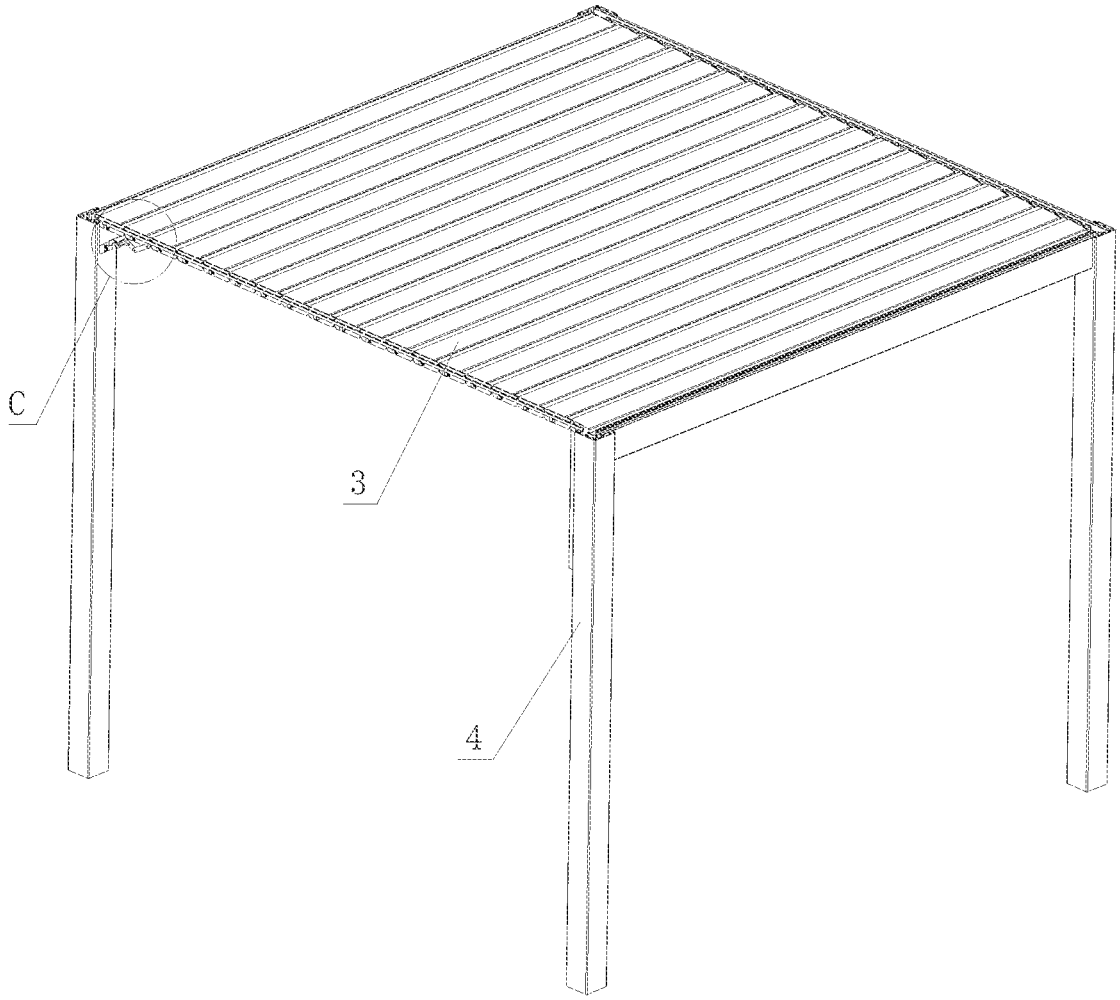
FIG. 10 is a schematic structural diagram of a driving mechanism of an outdoor awning provided in Embodiment I according to the present disclosure.
Figure 11:
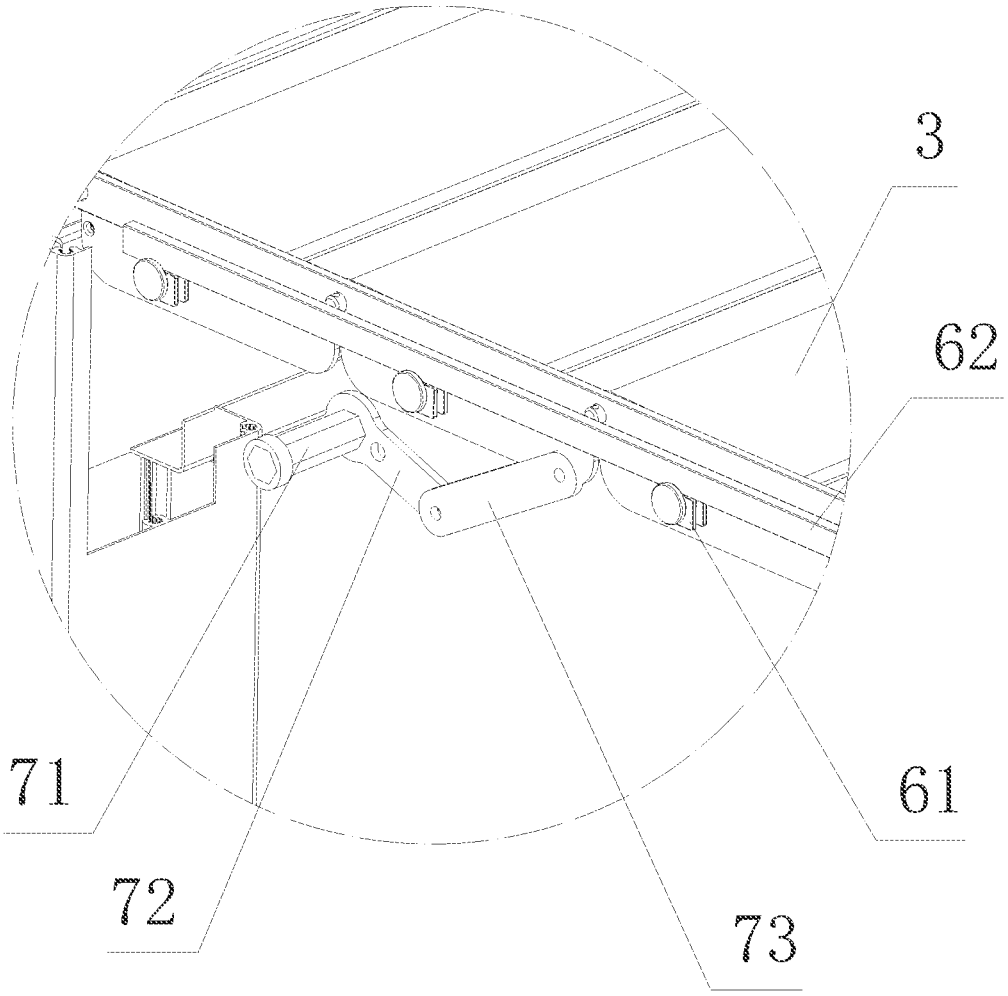
FIG. 11 is an enlarged view of Part C in FIG. 10.

Embodiments of the present disclosure will be described in detail below in conjunction with the accompanying drawings.

Referring to FIG. 1 to FIG. 22, the present disclosure provides an outdoor awning, which includes a ceiling, a driving mechanism, support legs 4, and tensioning mechanisms.

As a sunshade main body, the ceiling includes a frame structure and a plurality of louvers 3 disposed on the frame structure. The louvers 3 are rotatably installed on the frame structure. Rotation axes of the louvers are parallel to the length directions thereof. Connecting rods 7 are disposed at end portions of the louvers 3 to achieve linkage. Specifically, a convex shaft 38 is disposed at the end portion of each of the plurality of louvers. The connecting rods are provided with convex shaft holes, through which the convex shafts can pass, so that the linkage among the plurality of louvers is achieved, and the louvers are enabled to rotate synchronously. The frame structure includes two first cross beams 1 disposed in parallel, second cross beams 2 are fixed to two ends of the first cross beams 1, and the first cross beams are perpendicular to the second cross beams, thus forming the rectangular frame structure as a whole. Each of the first cross beams is provided with a strip-shaped protrusion 11, and the length direction of the strip-shaped protrusion is parallel to that of the first cross beam, so that a mounting portion is formed by the strip-shaped protrusion 11. The mounting portion is provided with mounting grooves 110, upper ends of which are open. The mounting grooves 110 are formed equidistantly along a length direction of the mounting portion, and mounting bases 61 are detachably disposed inside the mounting grooves 110. The mounting bases are made of plastic. Each of the mounting bases is provided with a shaft hole, and hinge shafts 39 are disposed at the end portions of the louvers 3. The hinge shafts are sleeved inside the shaft holes to achieve the rotary connection of the louvers. In order to improve installation reliability, the strip-shaped protrusions 11 are provided with strip-shaped clamping strips 62 with U-shaped cross sections, and the strip-shaped clamping strips are clamped on the strip-shaped protrusions 11 for limiting the mounting bases and the hinge shafts, so that the installation reliability and use stability of the louvers are improved.

Each of the plurality of louvers includes a louver body, the cross section of which is rectangular. In this embodiment, an upper surface of the louver body has a certain slope, and a reinforcing rib 34 is disposed inside the louver body. A bottom surface of the louver body extends forward for formation of a first shielding portion 321, an end portion of the first shielding portion 321 is bent upward by 90 degrees for formation of a second shielding portion 322, and an end portion of the second shielding portion 322 is bent backward by 90 degrees for formation of a third shielding portion 323. A first shielding area is defined by the first shielding portion, the second shielding portion and the third shielding portion. A top surface of the louver body extends backward for formation of a fourth shielding portion 311, and an end portion of the fourth shielding portion 311 is bent downward by 90 degrees for formation of a fifth shielding portion 312. When the louvers are located in a shielding station, that is, when the louvers are unfolded to a shielding position, in this embodiment, the fifth shielding portions 312 are located in the first shielding area of the adjacent louvers, are configured to shield interstices between the two adjacent louvers, and can prevent rainwater and the like from falling off from the interstices, so that a good shielding effect is achieved.

In order to further improve the shielding reliability and user experience, bottom surfaces of the first cross beams or the second cross beams extend inward for formation of sixth shielding portions 13, and end portions of the sixth shielding portions are bent upward by 90 degrees for formation of seventh shielding portions 14, so that a second shielding area is formed. The second shielding area can shield interstices between the louvers and the frame structure, so as to avoid the rainwater and the like dripping into the awning, thus achieving a good user experience. In addition, eighth shielding portions 12 with rectangular cross sections are provided at outer sides of upper ends of the first cross beams or the second cross beams, and are located at outer sides of the strip-shaped protrusions 11 so as to be capable of hiding the end portions of the louvers. As a result, the purpose of protection is achieved and the aesthetic feeling is improved.

The driving mechanism is installed on the ceiling and connected to one of the louvers 3 to drive same to rotate. Different embodiments of the driving mechanism will be described below.

Embodiment I: The driving mechanism includes a first shifting lever 72 and a second shifting lever 73, the first shifting lever 72 is hinged at an end portion of one of the louvers and its rotation axis is parallel to the rotation axis of the louver, the second shifting lever is hinged at an end portion of the first shifting lever, an end portion of the second shifting lever is rigidly connected to an output end of the worm gear box 9, and the rotation of the output end 71 of the worm gear box drives the first shifting lever to rotate, and then drives the louver to rotate.

Embodiment II: The driving mechanism includes a gear box 10 and a worm gear box 9, the gear box 10 is internally provided with a first gear 101 and a second gear 102 which are engaged with each other, and the number of teeth of the second gear 102 is greater than that of the first gear 101, that is, the diameter of a reference circle of the second gear is greater than that of the first gear. Furthermore, a driven gear 103 is fixed at an end portion of a hinge shaft of one of the louvers, the number of teeth of the driven gear is less than that of the second gear, and the driven gear 103 is engaged with the second gear 102. In order to protect the driven gear, a protective cover 104 is installed outside the driven gear, and the driven gear is located inside the protective cover, thus achieving the waterproof and dustproof purposes. When a power end is manually operated, an output shaft of the worm gear box is connected to the first gear. At this time, the first gear is sleeved outside the output shaft of the worm gear box by means of a key. When the power end is driven by electricity, the output shaft of the worm gear box is connected to the second gear. At this time, the second gear is sleeved outside the output shaft of the worm gear box by means of a key.

Figure 12:
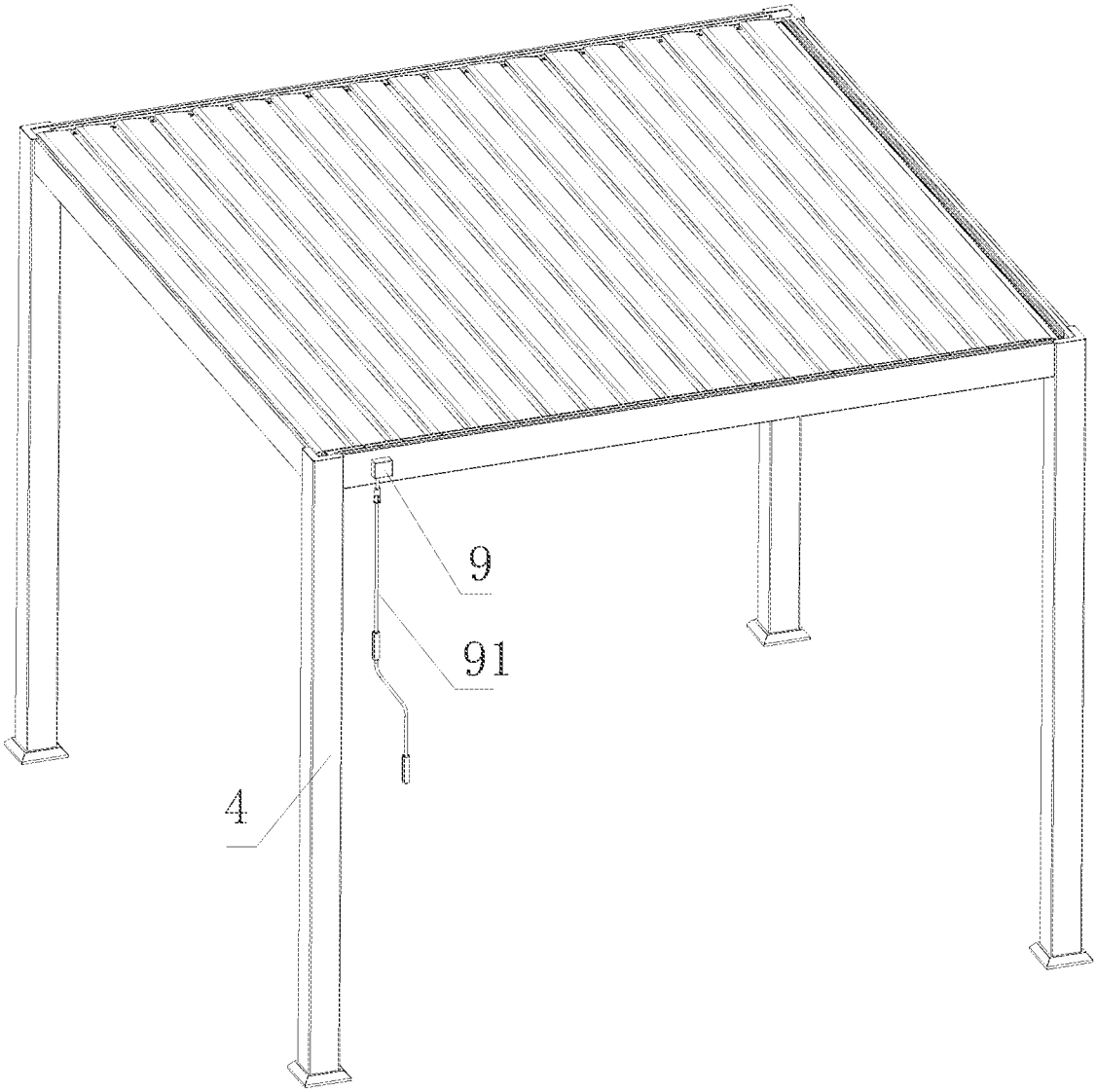
FIG. 12 is a schematic structural diagram of the outdoor awning in a manual drive mode according to the present disclosure.
Figure 13:
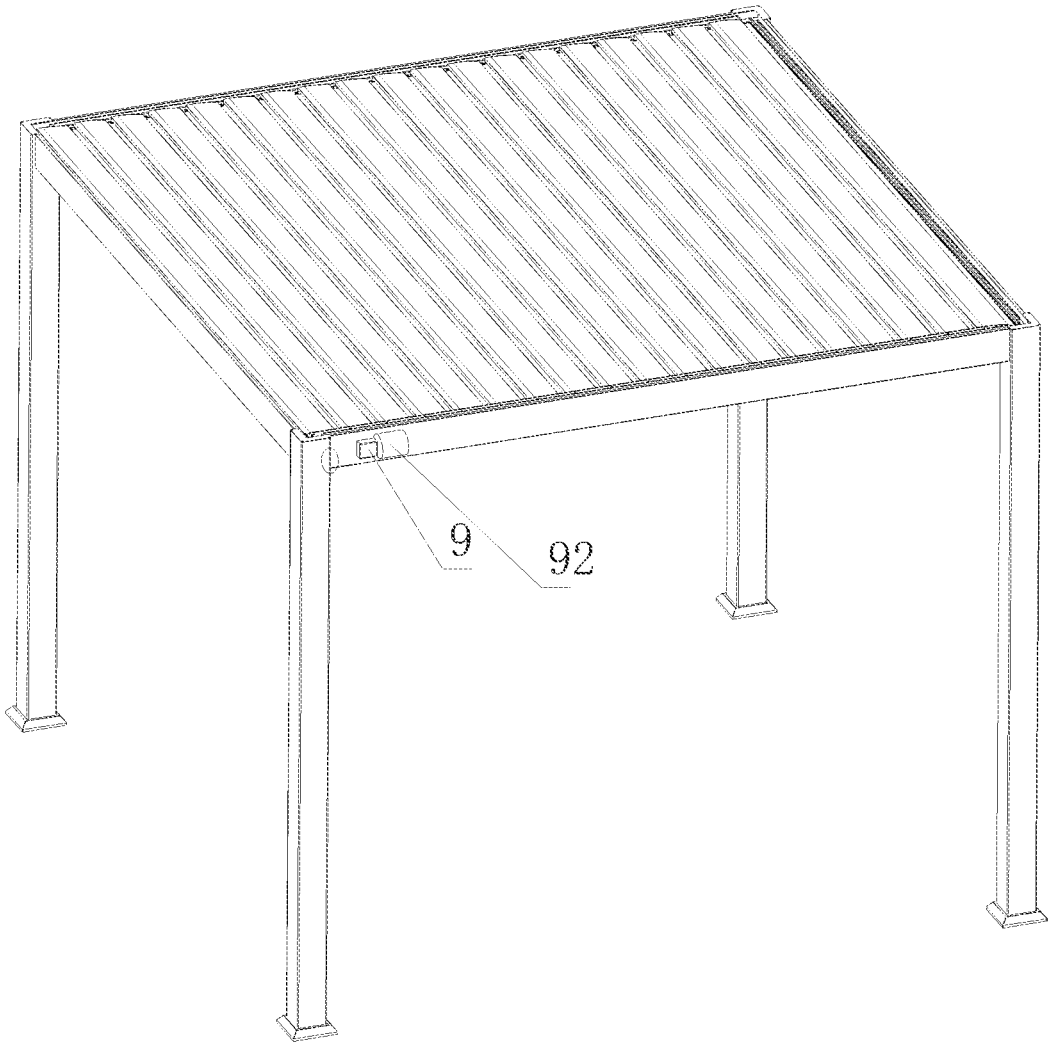
FIG. 13 is a schematic structural diagram of the outdoor awning in an electric drive mode according to the present disclosure.
Figure 14:
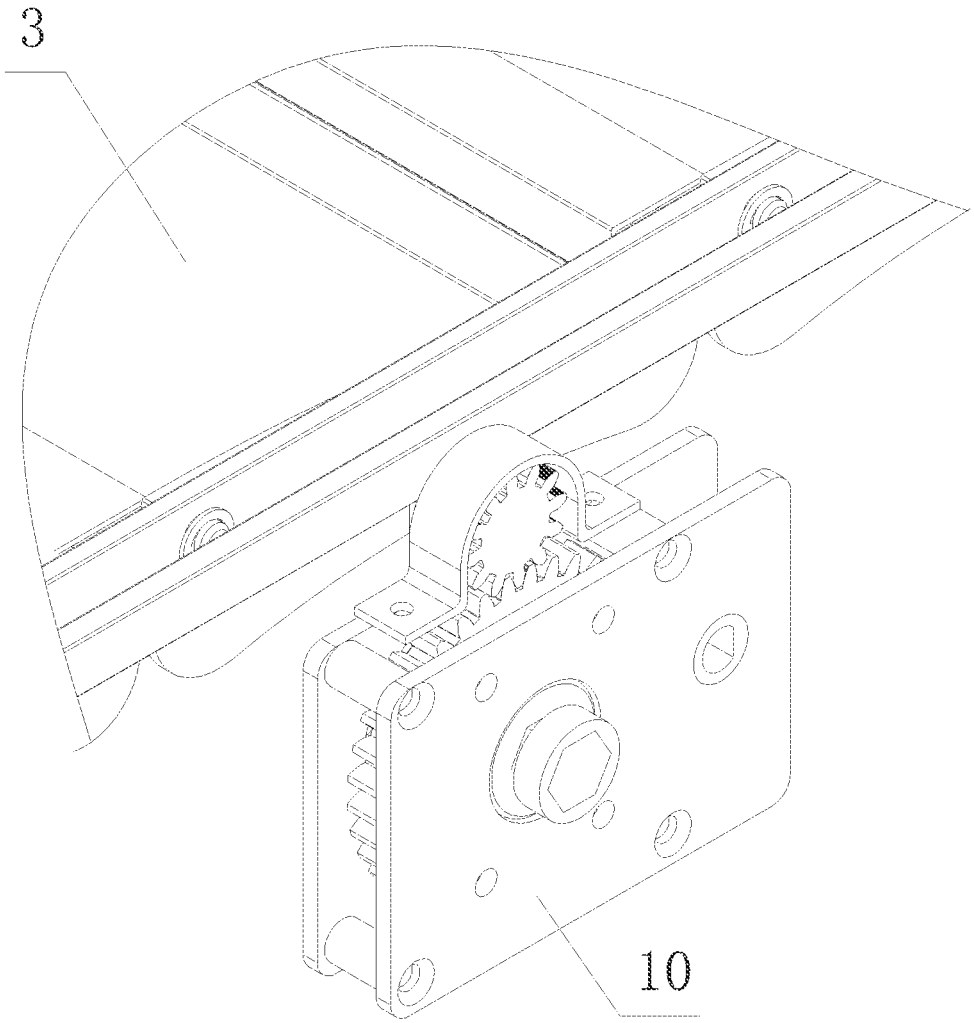
FIG. 14 is a schematic diagram showing the installation of a driving mechanism of an outdoor awning provided in Embodiment II according to the present disclosure.
Figure 15:
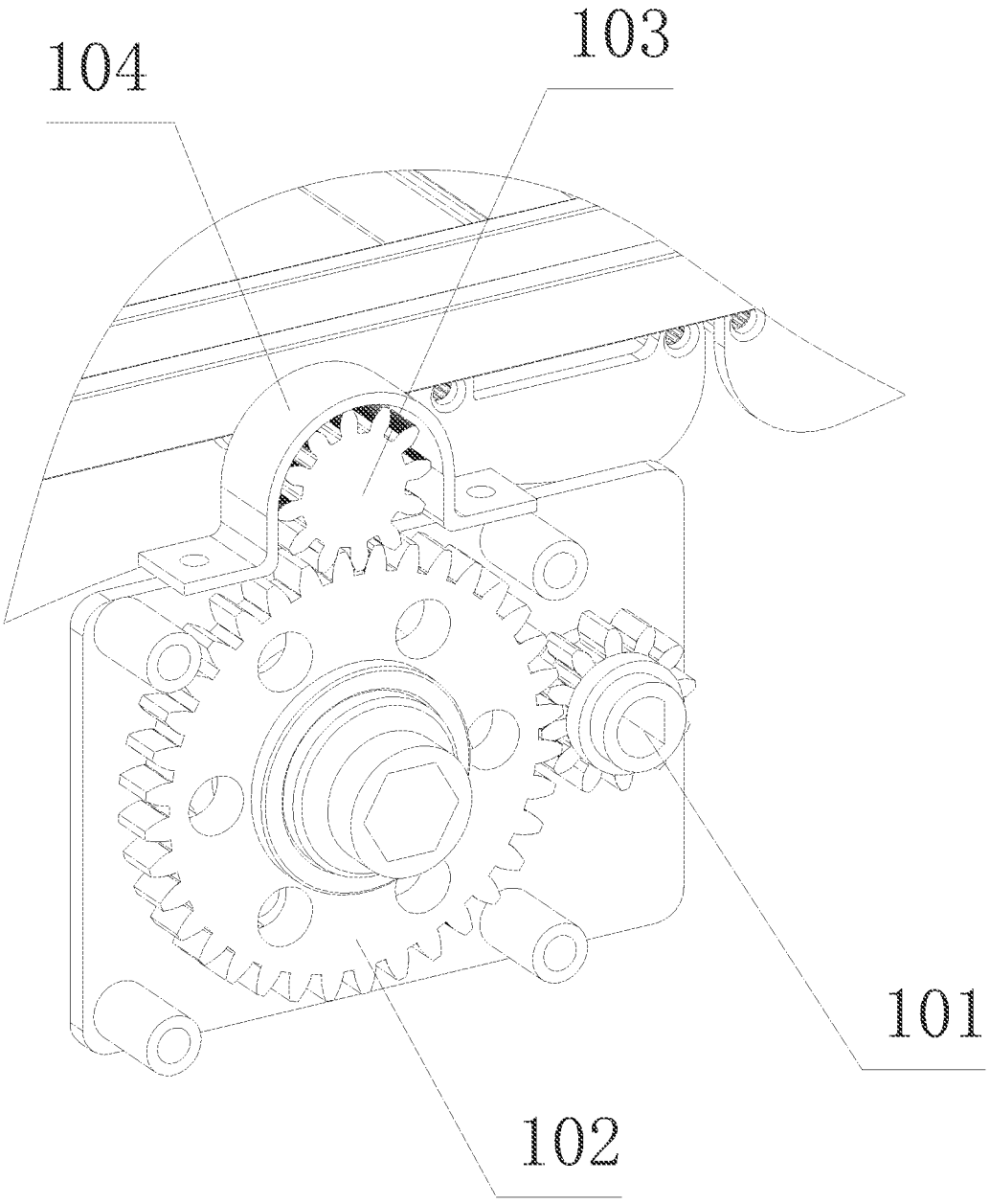
FIG. 15 is a schematic structural diagram of the driving mechanism of the outdoor awning provided in Embodiment II according to the present disclosure.
Figure 16:
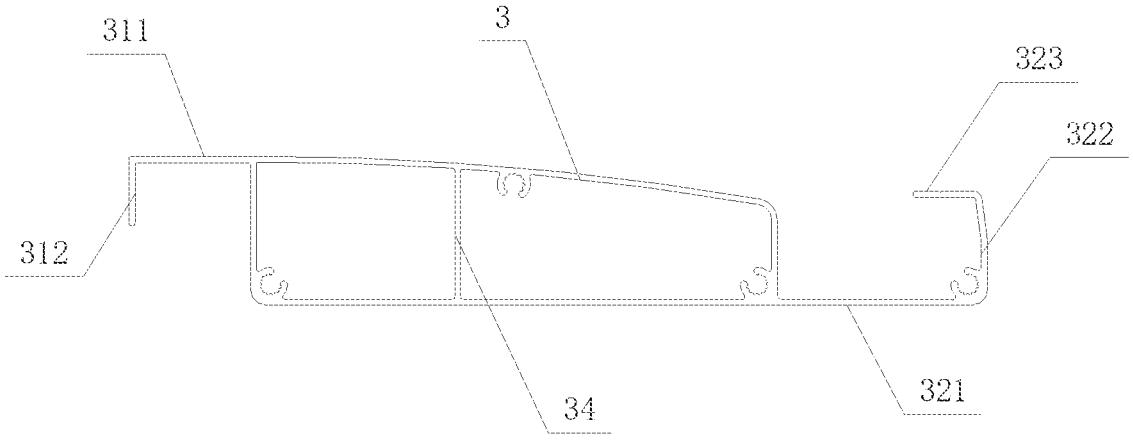
FIG. 16 is a schematic structural diagram of the louvers of the outdoor awning according to the present disclosure.
Figure 17:
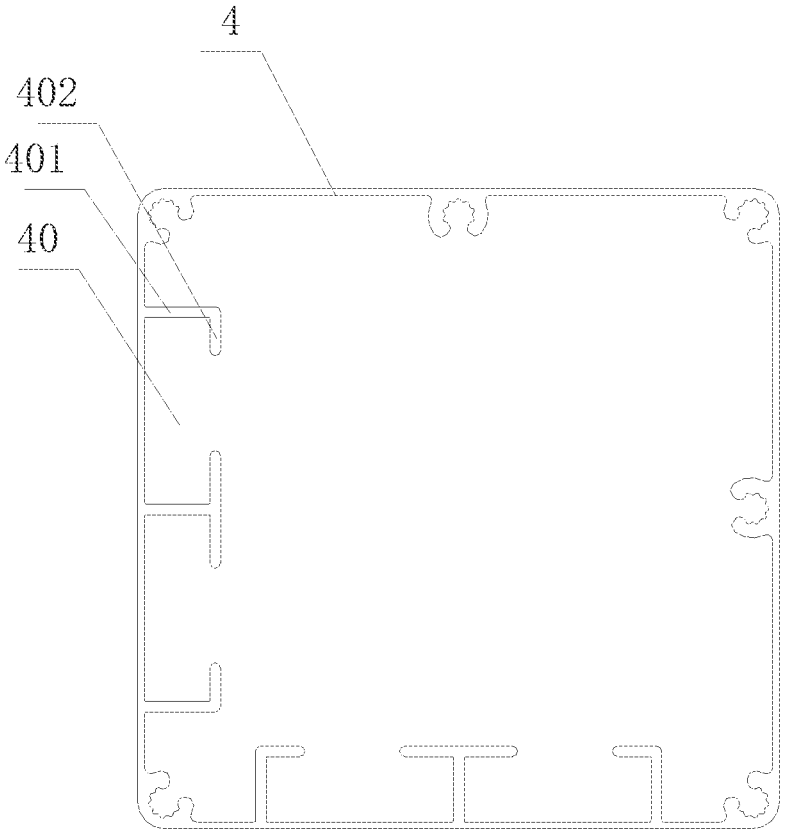
FIG. 17 is a schematic structural diagram of a support leg of the outdoor awning according to the present disclosure.
Figure 18:
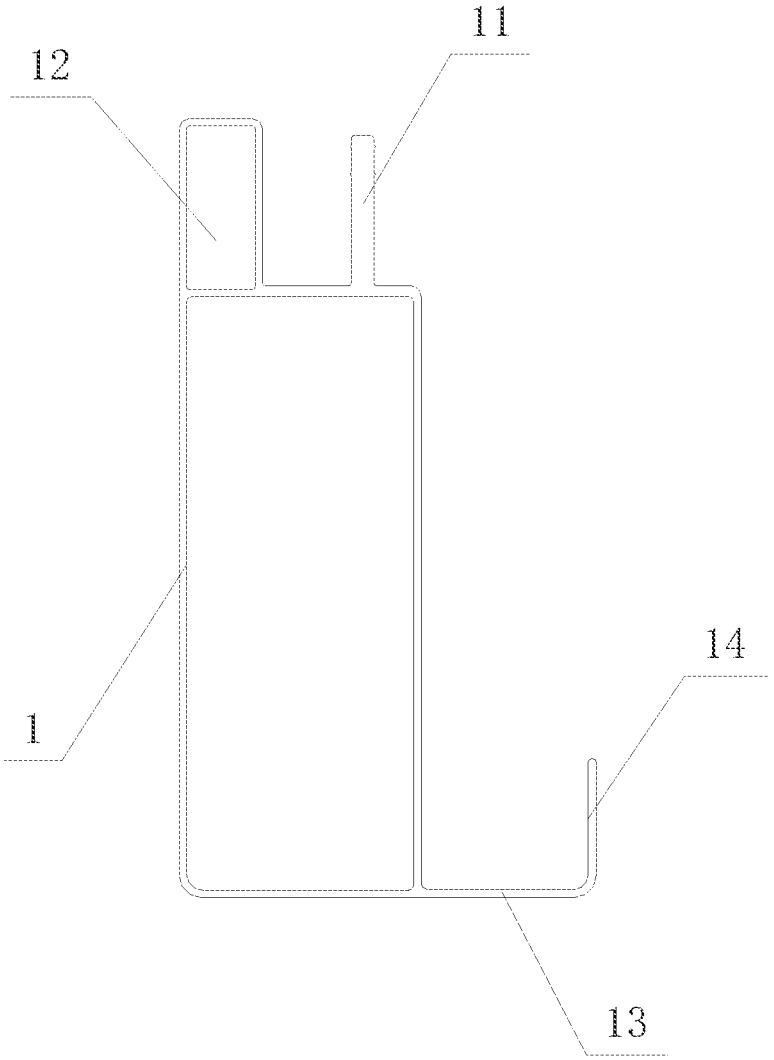
FIG. 18 is a schematic structural diagram of a first cross beam of the outdoor awning according to the present disclosure.
Figure 19:
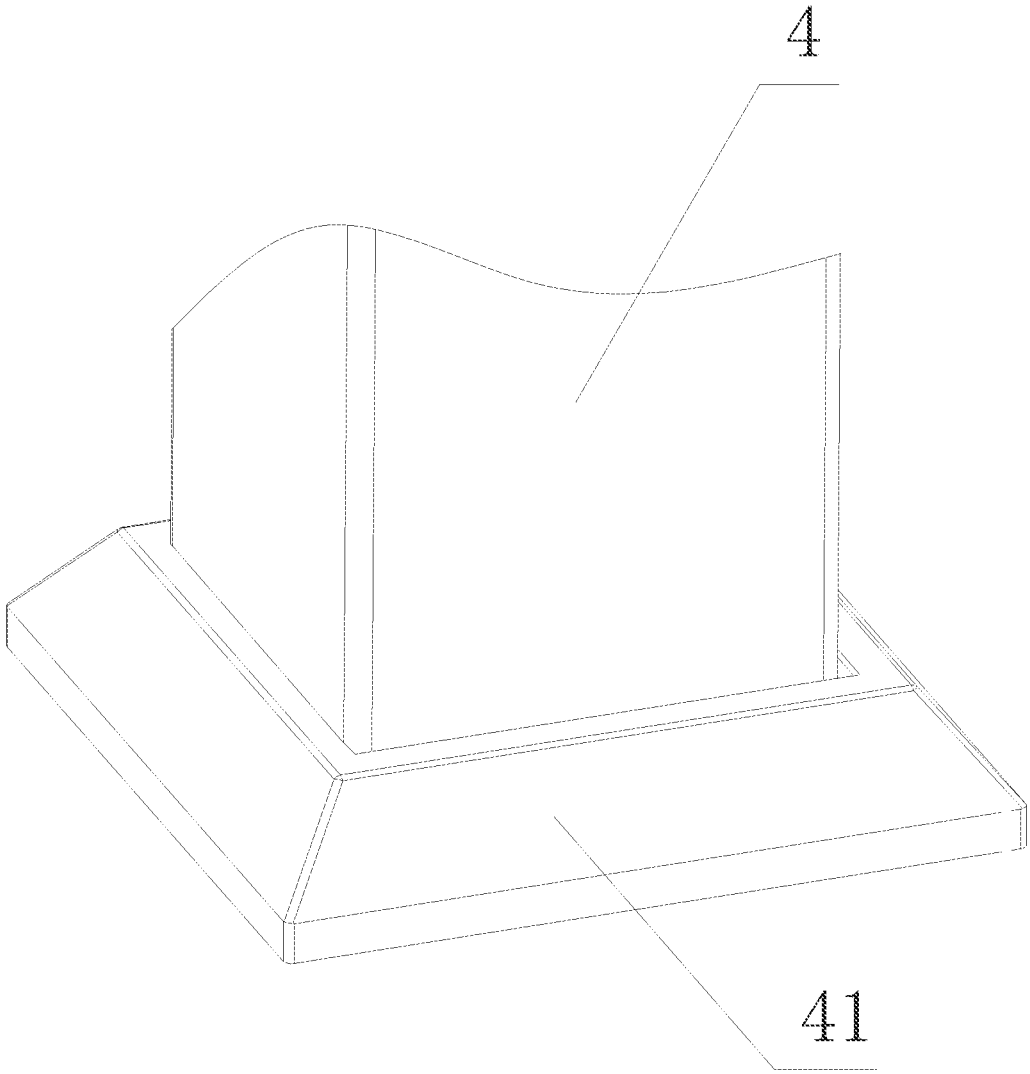
FIG. 19 is a schematic diagram showing the installation of a support leg bottom cover of the outdoor awning according to the present disclosure.
Figure 20:
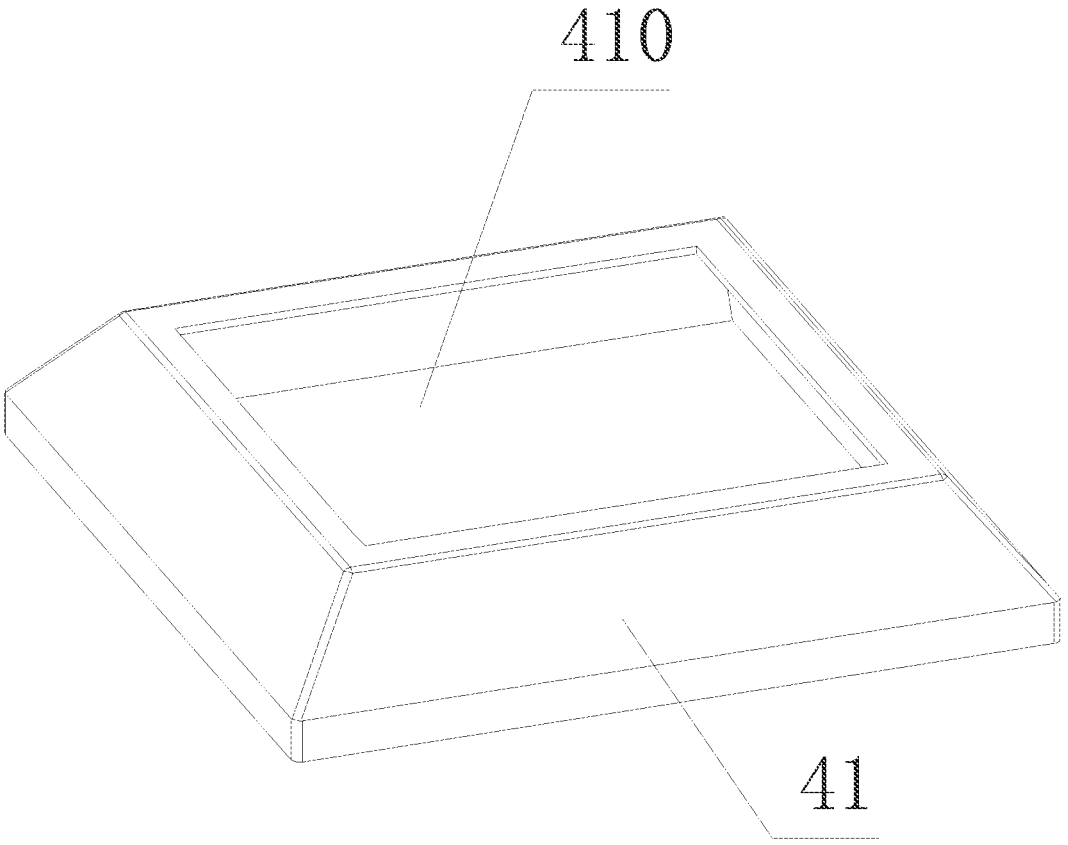
FIG. 20 is a schematic structural diagram of the support leg bottom cover of the outdoor awning according to the present disclosure.
Figure 21:
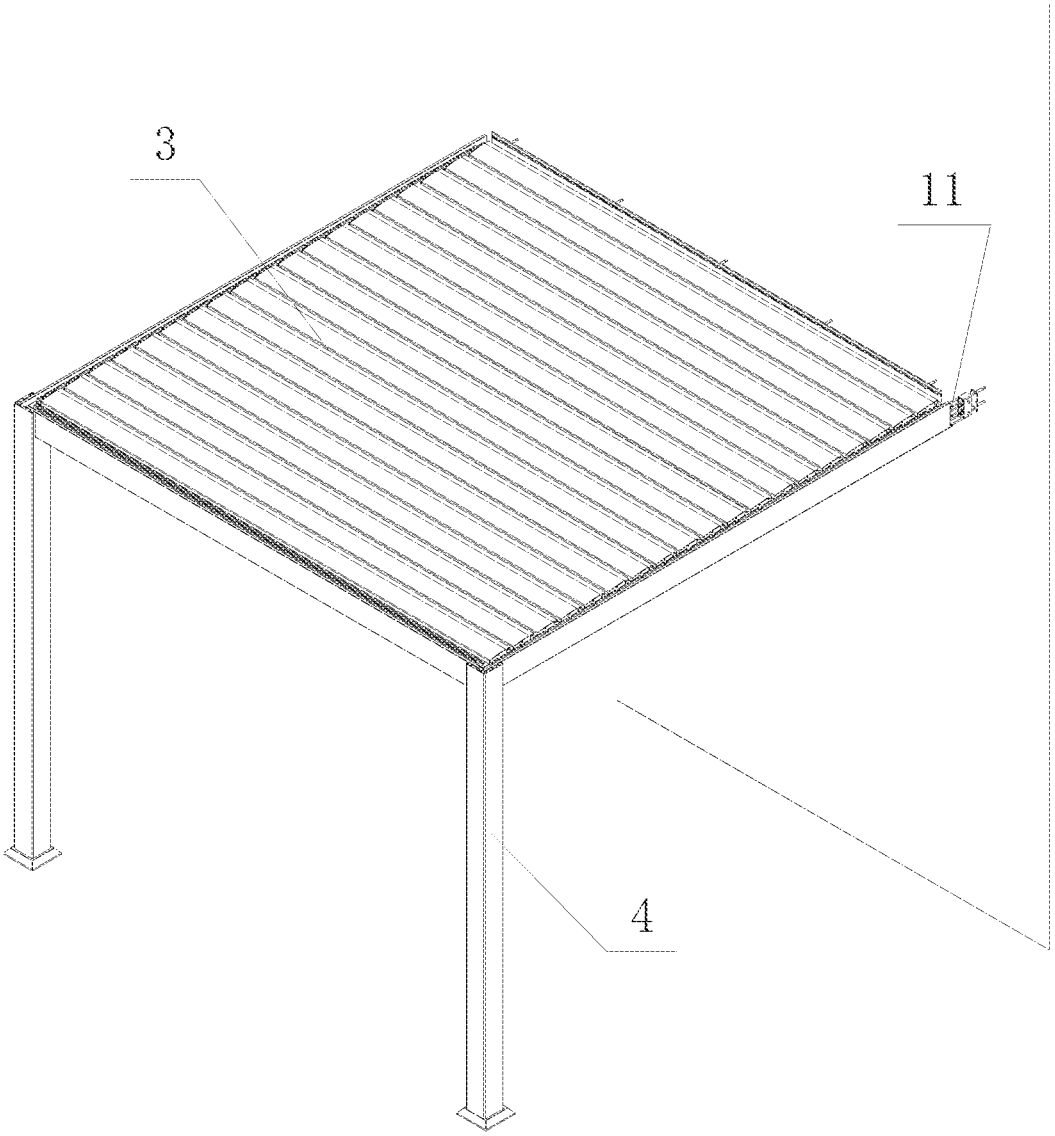
FIG. 21 is a schematic diagram of a wall-fixed type structure of the outdoor awning according to the present disclosure.
Figure 22:
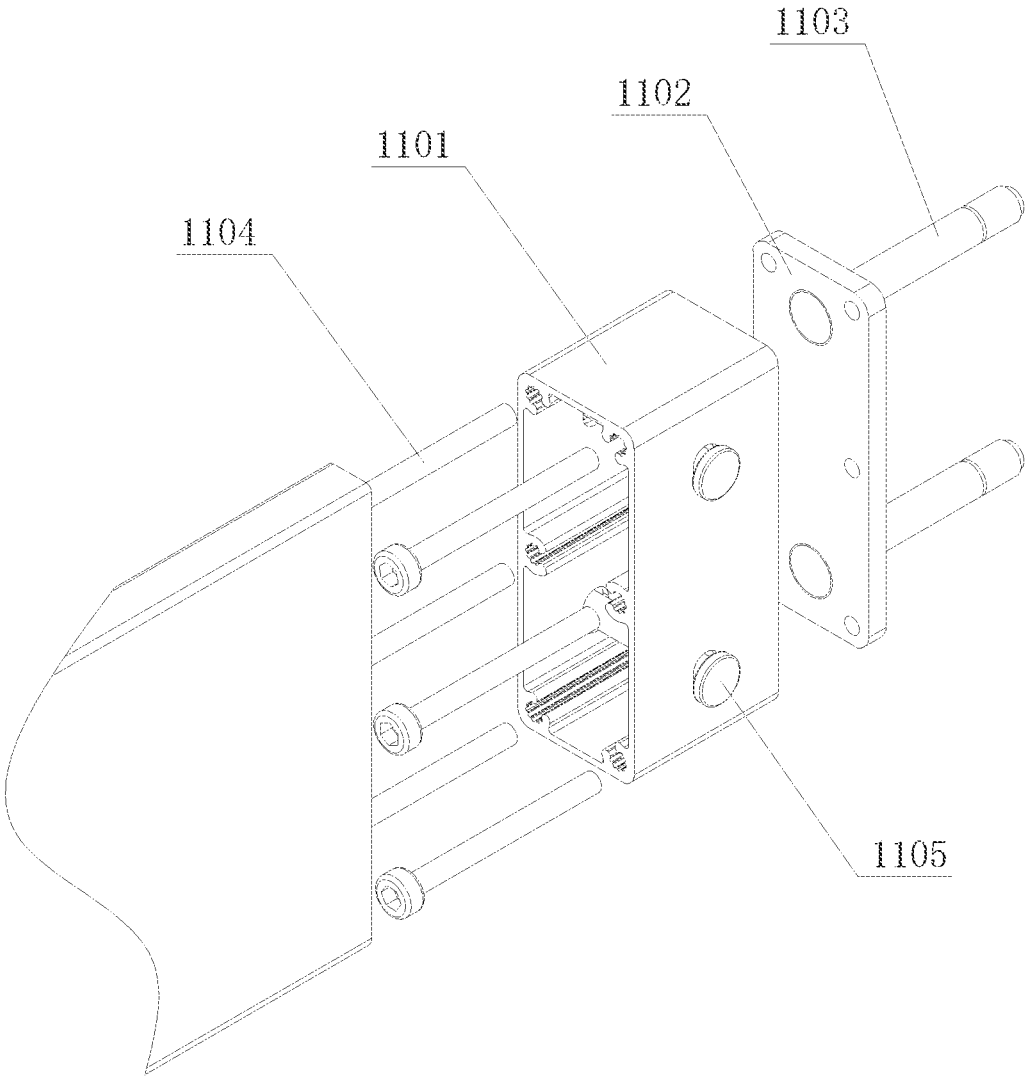
FIG. 22 is a schematic structural diagram of a connecting assembly of the outdoor awning according to the present disclosure.

In this application, the driving mechanism can be a manual drive mode and an electric (motor) drive mode. The worm gear box includes a worm box housing, in which a worm gear and a worm are rotatably installed. The worm is engaged with the worm gear, and extends as an input end to the outside of the worm box housing. When in the electric drive mode, an end portion of the worm is connected to a driving motor. At this time, the worm is horizontally disposed to facilitate motor installation, as shown in FIG. 13. When in the manual drive mode, the end portion of the worm is fixed to a sleeve, which can be manually driven by means of a handle 91. At this time, the worm is vertically disposed for easy operation, as shown in FIG. 12. In this application, the worm gear box 9 is installed on the side wall of the frame structure and can be selected according to different market demands.

The support legs 4 are made of hollow profiles and are fixed on the side walls of the ceiling, preferably fixed at four corners of the frame structure to support the ceiling. Bottoms of the support legs 4 are radially bent outward to form connecting portions, in which a plurality of mounting holes are formed, and thus the connecting portions can be fixed on a bottom surface by means of anchor bolts, with high installation strength and good wind resistance performance. In order to prevent bolt exposure, avoid collisions and improve overall aesthetics, a cover body 41 is sleeved outside the bottom of each of the support legs. The cross-sectional shapes of the cover bodies are the same as those of the support legs 4. In this embodiment, the cover bodies are rectangular, and a hole body 410 is formed in each of the cover bodies for the penetration of the corresponding support leg. The cross-sectional shapes and contours of the hole bodies are the same as those of the support legs, and the sizes thereof are slightly larger than the outer wall sizes of the support legs. The side walls of the support legs have inclined surfaces and have no convex corners, thus providing a good user experience. For ease of assembling and disassembling, each of the cover bodies can be formed by splicing two L-shaped half cover bodies.

A connecting assembly 11 is disposed at one side of the frame structure, and the connecting assembly 11 is configured to realize a fixed connection with the wall surface. This fixing mode adopts a wall-fixed type structure. The connecting assembly includes a fixing plate 1102 and a connecting seat 1101. The fixing plate is plate-shaped. First connecting holes are formed in the fixing plate, which can allow the fixing plate to be fixedly connected to the wall surface by means of expansion bolts 1103, and then attached to the wall surface. Furthermore, second connecting holes are formed in the fixing plate, and the second connecting holes are screw holes. The connecting seat 1101 is fixedly connected to the fixing plate 1102 by means of connecting bolts 1104. The connecting seat 1101 is of a slotted cuboid structure, which is fixed on the frame structure by means of bolts or rivets 1105, and specifically, is installed inside the profile of the frame structure. In this embodiment, the connecting seat is fixed in an opening reserved in an end portion of the cross beam (profile).

When the wall-fixed type structure is adopted, one end of the frame structure is fixedly connected to the wall surface, and the other end thereof is provided with two support legs for supporting; and when a bottom-fixed type structure is adopted, there are four support legs, which are fixed to the bottom surface by means of the anchor bolts.

The tensioning mechanisms are fixed on the side walls of the ceiling, and the support legs 4 are provided with insertion holes 40, into which the tensioning mechanisms can be inserted to achieve tensioning and fixation. Specifically, each of the tensioning mechanisms includes a first tensioning block 51, a second tensioning block 52, a locking bolt 53 and a locking nut 54, the first tensioning block 51 is fixed on the side wall of the ceiling, each of first tensioning block and the second tensioning block is provided with a hole, the locking bolt 53 passes through the first tensioning block 51 and the second tensioning block 52 sequentially from top to bottom and is connected to the locking nut 54, and the locking nut 54 is in sliding fit with the corresponding support leg 4, which can realize axial movement and cannot be rotated radially. In this embodiment, the locking nut has a rectangular structure, and a contact surface between the first tensioning block 51 and the second tensioning block 52 is an inclined surface. When the locking bolts are screwed down, the locking nuts are pulled to move upward and press against bottom surfaces of the second tensioning blocks. Under the action of the inclined surfaces, the second tensioning blocks move outward, and working surfaces of the second tensioning blocks press against inner walls of the insertion holes so as to achieve tensioning and fixation. In order to improve the connection reliability and avoid slipping, side walls (tensioning working surfaces) of the first tensioning blocks 51 and/or the second tensioning blocks 52 are provided with serrated edges 5*a*, which can increase a friction force with the insertion holes and improve the connection reliability. A boss 511 is disposed on a rear end face of each of the first tensioning blocks 51, and the width of the boss 511 is smaller than that of the first tensioning block. Mounting surfaces for fitting side walls of the support legs 4 are formed on end faces of the bosses 511, an interstice is reserved between each of the mounting surfaces and the side wall of the corresponding first tensioning block 51 for formation of an insertion slot, and a limiting portion provided on the corresponding support leg can be inserted into the insertion slot.

In this embodiment, each of the support legs 4 is provided with the at least two tensioning mechanisms, and the at least two tensioning mechanisms on the same support leg are located on different planes. Specifically, each of the support legs 4 includes a support leg body with a rectangular cross section. Inner walls of the support leg body are provided with parallel strip-shaped clamping strips 401. The length directions of the strip-shaped clamping strips are parallel to the length direction of the support leg body. End portions of the strip-shaped clamping strips are bent by 90 degrees in opposite directions for formation of a limiting portion 402. The insertion holes 40 are formed between the limiting portion and the strip-shaped clamping strips. The thicknesses of the insertion holes are the same as those of the tensioning mechanisms. Inner walls of the strip-shaped clamping strips 401 are used to contact tensioning surfaces of the tensioning mechanisms to achieve tensioning connection. In this embodiment, there are two insertion holes 40, which are reserved in the two adjacent inner walls of the support leg body. A slot is formed in an upper end of each of the support leg, the slot runs through the two adjacent side walls of the support leg, and the frame structure can be clamped into the slot and be in contact with an end portion of the slot so as to be supported. The slots allow the insertion holes face the side walls of the frame structure to achieve installation and fixation.

In this embodiment, the louvers, the frame structure (the first cross beams, the second cross beams), and the support legs are all made of aluminum profiles, that is, the awning is formed by aluminum extrusion, thus being high in strength, light in weight, and high in structural strength.

According to the outdoor awning provided by the present disclosure, the ceiling adopts a louver structure, which can adjust the amount of shielding according to needs, so that the outdoor awning is comfort to use and good in user experience. The shielding portions are provided on the louvers and a frame for shielding the interstices between the two adjacent louvers as well as between the louvers and the frame, which avoids rainwater and the like dripping into the awning, so that the awning is good in shielding effect and user experience. The support legs adopt the tensioning mechanisms, and are fixed by tensioning, so that the awning is convenient and labor-saving to assemble, and high in connection strength. The entire awning is made of the aluminum profiles, with high structural strength and light weight, making it easy to carry. Therefore, the outdoor awning provided by the present disclosure is compact in structure, convenient to assemble and good in user experience.

The foregoing descriptions are merely exemplary implementations of the present disclosure. It should be pointed out that for those skilled in the art, several improvements and modifications without departing from the technical principle of the present disclosure can also be made, which shall fall within the protection scope of the present disclosure.

The invention claimed is:

1. An outdoor awning, comprising:

a ceiling, as a sunshade main body, comprising a frame structure and a plurality of louvers disposed on the frame structure, wherein the louvers are rotatably installed on the frame structure, rotation axes of the louvers are parallel to length directions thereof, and connecting rods are disposed at end portions of the louvers to achieve linkage;

a driving mechanism, installed on the ceiling and connected to one of the louvers to drive the one of the louvers to rotate;

support legs, fixed on side walls of the ceiling for supporting the ceiling; and tensioning mechanisms, fixed on the side walls of the ceiling, wherein the support legs are provided with insertion holes, into which the tensioning mechanisms can be inserted to achieve tensioning and fixation;

wherein each of the tensioning mechanisms comprises a first tensioning block, a second tensioning block, a locking bolt and a locking nut, the first tensioning block is fixed on one of the side walls of the ceiling, each of the first tensioning block and the second tensioning block is provided with a vertically extending elongated hole, the locking bolt passes through the vertically extending elongated hole of the first tensioning block and the vertically extending elongated hole of the second tensioning block sequentially from top to bottom and is connected to the locking nut located below the second tensioning block, the locking nut is in sliding fit with the corresponding support leg, and a contact surface between the first tensioning block and the second tensioning block is an inclined surface;

wherein a boss is disposed on a rear end face of each of the first tensioning blocks, mounting surfaces for fitting side walls of the support legs are formed on end faces of the bosses, and an interstice is reserved between each of the mounting surfaces and the side wall of the corresponding first tensioning block for formation of an insertion slot.

2. The outdoor awning according to claim 1, wherein side walls of the first tensioning blocks and/or the second tensioning blocks are provided with serrated edges.

3. The outdoor awning according to claim 1, wherein each of the support legs is provided with the at least two tensioning mechanisms, which are located on different planes.

4. The outdoor awning according to claim 1, wherein the frame structure comprises two first cross beams disposed in parallel, and second cross beams are fixed to two ends of the first cross beams so as to form the frame structure, which is rectangular; each of the first cross beams is provided with a strip-shaped protrusion along a length direction for formation of a mounting portion, the mounting portion is provided with mounting grooves, the mounting grooves are formed equidistantly along a length direction of the mounting portion, and mounting bases are disposed inside the mounting grooves; and hinge shafts are disposed at the end portions of the louvers, and the hinge shafts are sleeved inside shaft holes of the mounting bases to achieve rotary connection.

5. The outdoor awning according to claim 4, wherein the strip-shaped protrusions are provided with strip-shaped clamping strips for limiting the hinge shafts.

6. The outdoor awning according to claim 1, wherein the louvers, the frame structure and the support legs are all made of aluminum profiles.

7. The outdoor awning according to claim 1, wherein each of the plurality of louvers comprises a louver body with a rectangular cross section; a bottom surface of the louver body extends forward for formation of a first shielding portion, an end portion of the first shielding portion is bent upward for formation of a second shielding portion, and an end portion of the second shielding portion is bent backward for formation of a third shielding portion; a first shielding area is defined by the first shielding portion, the second shielding portion and the third shielding portion; a top surface of the louver body extends backward for formation of a fourth shielding portion, and an end portion of the fourth shielding portion is bent downward for formation of a fifth shielding portion; and when in a shielding station, the fifth shielding portion is located in the first shielding area of the adjacent louvers and is configured to shield an interstice between the two adjacent louvers.

8. The outdoor awning according to claim 1, wherein each of the support legs comprises a support leg body with a rectangular cross section, inner walls of the support leg body are provided with parallel strip-shaped clamping strips, the length directions of the strip-shaped clamping strips are parallel to the length direction of the support leg body, end portions of the strip-shaped clamping strips are bent in opposite directions for formation of a limiting portion, the insertion holes are formed between the limiting portion and the strip-shaped clamping strips, and the at least two insertion holes are available and reserved in the two adjacent inner walls of the support leg body.

9. The outdoor awning according to claim 1, wherein a connecting assembly fixedly connected to a wall surface is disposed at one side of the frame structure, the connecting assembly comprises a fixing plate fixedly connected to the wall surface by means of expansion bolts and a connecting seat fixedly connected to the fixing plate by means of connecting bolts, and the connecting seat is fixed on the frame structure by means of bolts or rivets.

* * * * *